United States Patent [19]

Ibach

[11] Patent Number: 4,461,162

[45] Date of Patent: Jul. 24, 1984

[54] FORGING OF CONICAL LINERS

[75] Inventor: David R. Ibach, Anoka County, Minn.

[73] Assignee: Honeywell Inc., Minneapolis, Minn.

[21] Appl. No.: 420,199

[22] Filed: Sep. 20, 1982

[51] Int. Cl.[3] ..... B21D 22/00

[52] U.S. Cl. ..... 72/344; 72/354; 72/427; 72/360

[58] Field of Search ..... 72/352, 354, 356, 357, 72/358, 427, 344, 360

[56] References Cited

U.S. PATENT DOCUMENTS

| | | | |
|---|---|---|---|
| 2,789,344 | 4/1957 | Kaul | 72/358 |
| 3,056,197 | 10/1962 | Lawson | 72/370 |
| 3,417,597 | 12/1968 | Napoli | 72/354 |
| 3,608,350 | 9/1971 | Yamasuchi | 72/370 |
| 4,050,238 | 9/1977 | Schober | 72/354 |
| 4,051,708 | 10/1977 | Beaue et al. | 72/354 |

*Primary Examiner*—Leon Gilden

*Attorney, Agent, or Firm*—George W. Field

[57] ABSTRACT

Apparatus for forming, from a generally conical billet, a hollow forging of desired wall thickness having a generally conical portion tapering to a smaller cylindrical extension, the inner and outer surfaces of the conical portion having minor predetermined and spatially related devisions from purely conical configurations, said apparatus comprising, in combination, a die having a concave conical configuration, with a cylindrical extension at the smaller end, to conform to the desired external configuration of said forging; a punch having a convex conical configuration to conform to the desired configuration of the inner surface of the conical portion of the forging; and means mounting the punch for movement coaxially into the die from the larger end thereof, to an extent which determines the wall thickness of the forging.

4 Claims, 6 Drawing Figures

FIG. 3
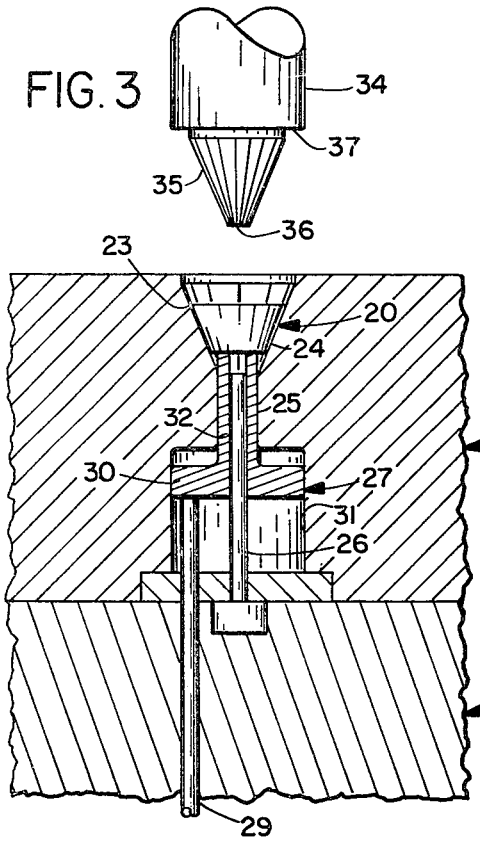
FIG. 4
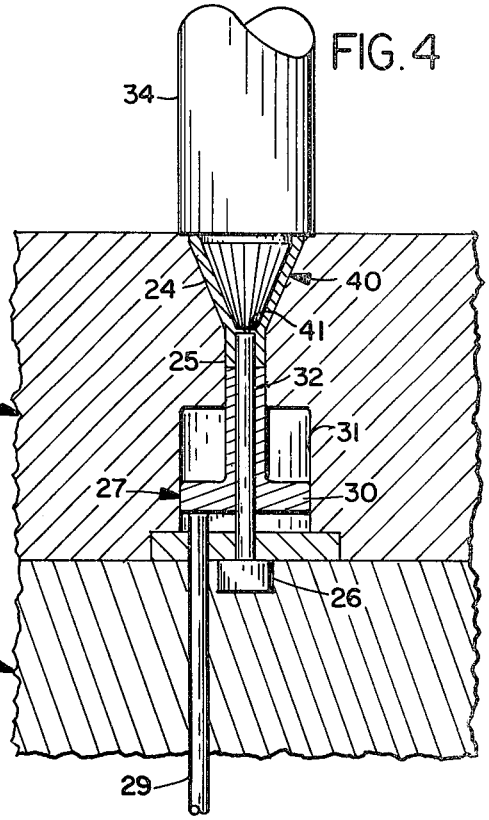
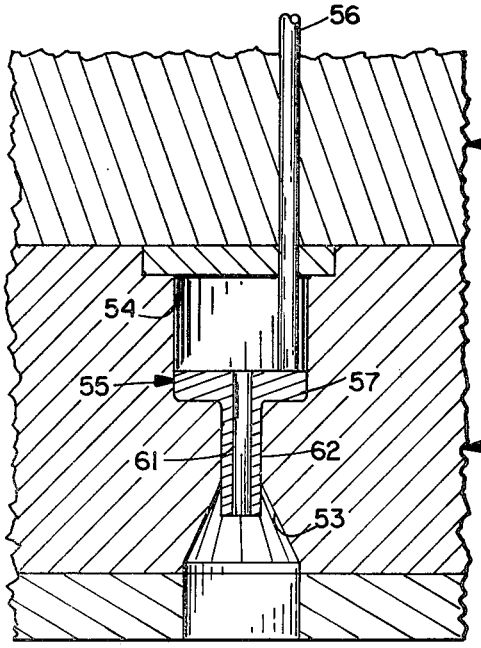
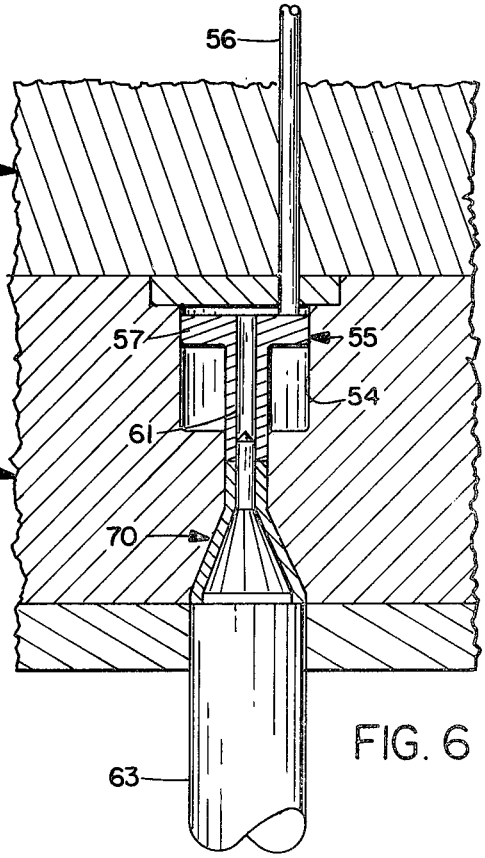
FIG. 5
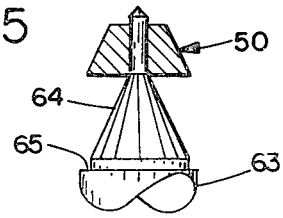
FIG. 6

FORGING OF CONICAL LINERS

The Government has rights in this invention pursuant to Contract No. DAAK10-78-C-0408 awarded by the Department of the Army.

TECHNICAL FIELD

This invention relates to the field of metal working, and more particularly to apparatus for manufacturing fluted liners for use in armor piercing projectiles.

BACKGROUND OF THE INVENTION

A component needed in the manufacture of armor piercing projectiles is a liner which is vaporized upon target impact and ejected at high velocity to penetrate the impacted armor. Such a liner is a hollow body of metal such as "electrolytic tough pitch copper," of predetermined wall thickness having a generally conical forward portion and a smaller, cylindrical rearward extension. It is found desirable for the conical portion of the liner to be fluted internally and externally, and the manufacture of such liners by the traditional coining procedures has been slow and difficult, and has required much manual positioning of individual pieces during manufacture.

BRIEF SUMMARY OF THE INVENTION

The present invention comprises apparatus by which the liners may be forged in single strokes from hot metal billets, so that manual positioning is unnecessary and production rate is high.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing, in which like reference numerals identify corresponding parts throughout the several views.

FIGS. 3 and 4 schematically show a first embodiment of apparatus to forge the liner, before and after the stoke of a punch, and FIG. 5 and 6 are views similar to FIGS. 3 and 4, but show a second embodiment of the invention.

DESCRIPTION OF THE PREFERRED EMBODIMENT

Figure 1:
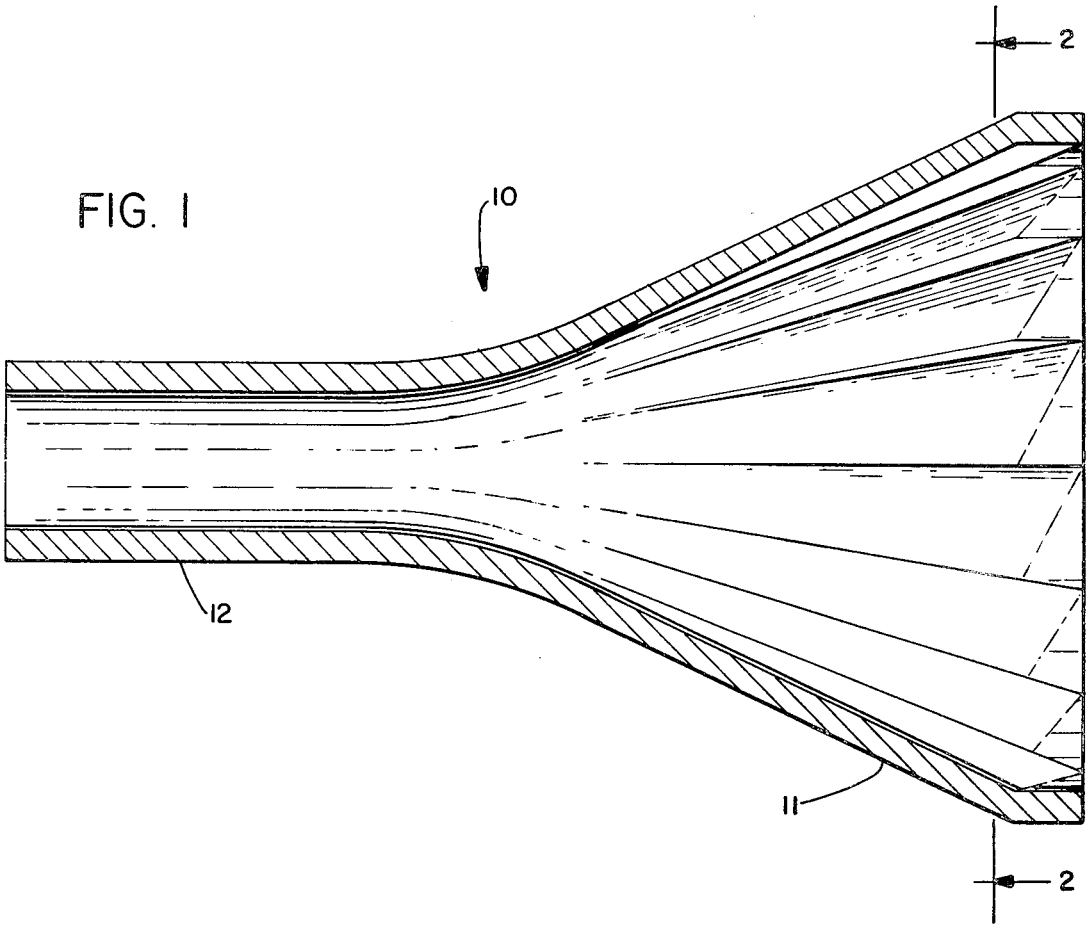
FIG. 1 shows in axial section a liner to be manufactured.
Figure 2:
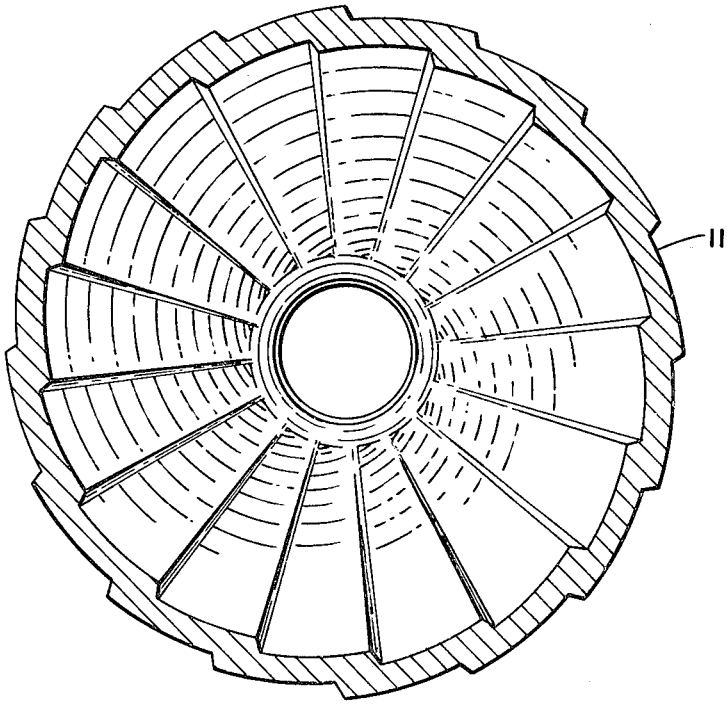
FIG. 2 is a transverse section of the liner along the line 2—2 of FIG. 1.

Referring to FIGS. 1 and 2, a hollow liner 10 according to the invention is shown to comprise a first generally conical portion 11 tapering to a normally cylindrical smaller extension 12. For reasons not relevant to the present application, the inner surface 13 and outer surface 14 of conical portion 11 have irregular, fluted deviations from the pure conical form, the inner and outer flutings being in a previously determined spacial relation, and the wall thickness as well as the apex angle of the liner being critical dimensions. The present invention comprises apparatus for forming a liner from a heated billet of metal at a single stroke. A preferred metal is commercially known as "electrolytic tough pitch copper".

FIGS. 3 and 4 show a first apparatus for forging the liner from a hot conical billet 20 of the metal. A die 21 supported on a die shoe 22 has a cavity 23 configured to form the outside of liner 10 with a generally conical portion 24 tapering to a smaller cylindrical extremity 25. A lower punch 26 is supported in shoe 22 to project into extension 25. A pilot and knock-out member 27 has an actuator 29 and a base 30 which moves in a second cavity 31 in die 21, and is normally resiliently supported in the position shown. A tubular pilot 32 of member 27 projects into die extension 25: the outer diameter of pilot 32 and the inner diameter of extension 25 are the same as the outer diameter of the liner extension 12, and the inside diameter of pilot 32 and the outside diameter of punch 26 are the same as the inside diameter of liner extension 12, and pilot 27 projects into die 21 to a point where the smaller base of billet 20 rests on it, to facilitate insertion of the billet into the die.

Cooperating with die 21 is a forging punch 34 having a conical portion 35 which is configured to form the inner surface of liner 10, and tapers to a small end 36 of generally the same diameter as lower punch 26.

FIG. 4 shows the apparatus at the end of the forging stroke to form a liner 40. Punch 34 has moved into die 21 until the determined wall thickness has been achieved. By plastic flow the metal of the billet has flowed outward and upward between die 21 and punch 34, to form the conical portion of the liner including the internal and external flutes, and has flowed downward around punch 26 to form the liner extension, displacing pilot 27 downwardly as necessary to make room for the metal.

The stroke of punch 34 determines the wall thickness of the conical portion of the liner, and punches 26 and 34 do not come into engagement so that a web of metal 41 remains across the inside of liner 40.

After the forging stroke punch 34 rises and member 27 is moved upwardly by actuator 29, to extract the liner 40 from the die. The ends of the liner may be squared if necessary, and web 41 is removed by a boring and polishing operation.

A second embodiment of the apparatus for forming liners according to the invention is shown in FIGS. 5 and 6, where the forging apparatus is inverted, and the billet 50 has an axial hole. A die 51 is supported against a shoe 52 and has a cavity 53 and a chamber 54 as described above. A pilot and knock-out member 55 has an actuator 56 and a base 57 movable in chamber 54, and is normally maintained by gravity in the position shown, with a tubular pilot 61 projecting downward through the cylindrical extension 62 of cavity 53. The outside diameter of pilot 61 and the inside diameter of extension 62 are the same as the outside diameter of liner extension 12.

A forging punch 63 cooperates with die 51, and includes a conical portion 64 and a shoulder 65 as described above for punch 34. However, punch 63 also has a pilot pin 66 aligned with pilot 61. The inside diameter of pilot 61 and the outside diameter of pin 66 are the same as the desired inside diameter of liner extension 12, and the hole in billet 50 allows the billet to be placed on pin 66 as shown in FIG. 5.

FIG. 6 shows the apparatus at the end of the forging stroke to form the billet into a liner 70. Punch 63 has engaged die 21, carrying billet 50 with it. By plastic flow the metal of the billet has moved outward between die 51 and punch 63, to form the conical portion of the liner including the internal and external flutes, and has also flowed upward into die extension 62 to form the liner extension, displacing pilot 61 upwardly as necessary to make room for the metal. As before, the stroke of the punch determines the wall thickness of the conical portion of the liner.

After the forging stroke punch 63 separates from die 51 and member 57 is moved downwardly, by actuator 56, to extract the liner 70 from the die. The ends of the forging may be squared off if this is necessary, but in this embodiment of the invention no internal web is formed in the liner.

From the above it will be evident that the invention comprises an apparatus for forming a liner by forging from a billet of hot metal, the apparatus including a concave die, one or more convex punches, and a pilot and knock-out member movable in the die.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. Forging apparatus comprising, in combination:

a die having a concave tapering configuration, with a cylindrical extension at the smaller end;

a first punch having a concave tapering configuration;

a second punch having a diameter less than the inside diameter of said extension;

means mounting said second punch to project co-axially into said extension of said die from said smaller end;

and means mounting said first punch for movement co-axially into said die from the larger end thereof.

2. Apparatus according to claim 1 further including knock-out means surrounding said second punch and extending axially into said cylindrical extension of said die, for moving axially along said second punch.

3. Apparatus according to claim 1 in which movement of said first punch terminates short of contact with said second punch.

4. Apparatus according to claim 1 in which said knock-out means initially projects into said extension of said second punch.

* * * * *